United States Patent [19]

Braginetz

[11] 3,941,244

[45] Mar. 2, 1976

[54] MAGAZINE FOR RAZOR BLADE CARTRIDGES

[75] Inventor: Paul A. Braginetz, Staunton, Va.

[73] Assignee: Philip Morris Incorporated, New York, N.Y.

[22] Filed: Feb. 12, 1975

[21] Appl. No.: 549,355

Related U.S. Application Data

[63] Continuation of Ser. No. 364,715, May 29, 1973, abandoned.

[52] U.S. Cl. ..... 206/360; 30/40.2; 221/102; 221/66

[51] Int. Cl.[2] ..... A45D 21/24

[58] Field of Search ..... 30/40, 40.1, 40.2; 206/352, 354, 357, 358, 359, 360; 221/102, 279, 307, 308, 309, 310, 312 B, 66

[56] References Cited

UNITED STATES PATENTS 3,833,146 9/1974 Brahinetz ..... 206/252

*Primary Examiner*—William Price
*Assistant Examiner*—Joseph M. Moy
*Attorney, Agent, or Firm*—Watson Leavenworth Kelton & Taggart

[57] ABSTRACT

A magazine for razor blade cartridges in which the cartridges embody a plurality of blades permanently secured in a plastic body, the magazine including a main housing into which is insertable a spring clip preloaded with a stack of the cartridges, the housing having an end wall with a pair of openings a first one being adapted for the endwise insertion of a used cartridge at one end of the stack and a second opening being adapted for the endwise extraction of a new cartridge, the stack being pressed by elastic means toward the second opening, the arrangement and relation of the stack and the openings in the end wall being such that a used cartridge may be inserted at the first opening by endwise advance in contact with and parallel to the adjacent cartridge, the cartridge at the other end of the stack having its end fully exposed at said second opening but normally releasably restrained against accidental escape.

11 Claims, 9 Drawing Figures

MAGAZINE FOR RAZOR BLADE CARTRIDGES

This ia a continuation of application Ser. No. 364,715, filed May 29, 1973 and now abandoned.

The invention concerns a magazine for razor blade cartridges which serves as a dispenser or source of supply of new cartridges and a receptacle for used blades as the user of a razor finds it desirable to replace blades which have become dulled. Devices of such character are well known in general including magazines in which the cartridges are arranged in a row in the magazine and a used cartridge is inserted and new one removed by appropriate application of a compatibly designed razor head to the magazine housing. The cartridges in such systems have been of the type where one or more blades are permanently secured in a generally oblong shaped plastic body.

The prior application of the present applicant Ser. No. 334,746 filed Feb. 22, 1973, now U.S. Pat. No. 3,833,146 is directed to an improved structure and principle adapted to function in a particularly convenient and effective manner with a razor head compatibly designed to cooperate therewith in automatically changing cartridges. It embodies a housing in which is inserted a spring clip preloaded with a stack of cartridges, the stack having an elastic support therein with the stack engaged in a balanced floating manner between spring biasing elements. An edge of the housing has a first opening adjacent one end of the stack for the endwise insertion of a used cartridge, and a second opening adjacent the other end of the stack permitting endwise extraction of a new cartridge. The relation is such that normally the cartridges within the housing are blocked by the end wall of the housing but upon insertion of a used cartridge at the appropriate opening the stack is shifted in its elastic support such as to expose the new cartridge at the other end of the stack into registry with its exit opening.

The present invention concerns a modification of the magazine of said prior application of generally similar character in which a stack of cartridges is mounted in a housing with openings in the front wall for the endwise insertion and removal of cartridges. The internal arrangement, however, is different and also the relation of the stack to the end wall openings. In the present case a used cartridge is insertable without shifting of the stack and the bottom new cartridge has its outer end fully exposed normally and may be picked up and removed by the razor head. Parallelism is maintained among the cartridges of the stack and the used cartridge in its insertion. As just noted, the stack is not shifted upon insertion of a used cartridge and the stack does not move down to expose the next new cartridge until the bottom one has been fully removed. The characteristics and operation just described result from a novel arrangement within the housing of spring means and associated cartridge guide and supporting rails and ribs.

Various other features and advantages will become apparent from a consideration of a representative embodiment of the invention as hereinafter described and as depicted in the accompanying drawings in which.

Figure 1:
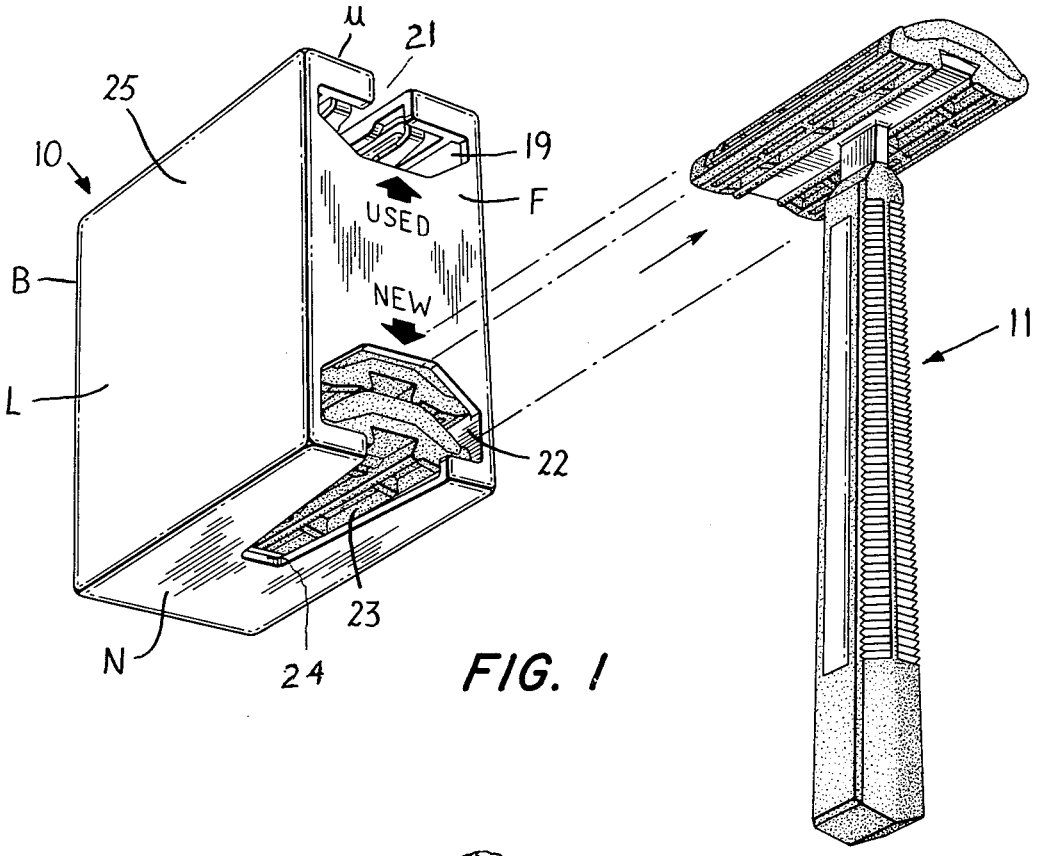
FIG. 1 is a composite view in perspective of the magazine and a razor.
Figure 2:
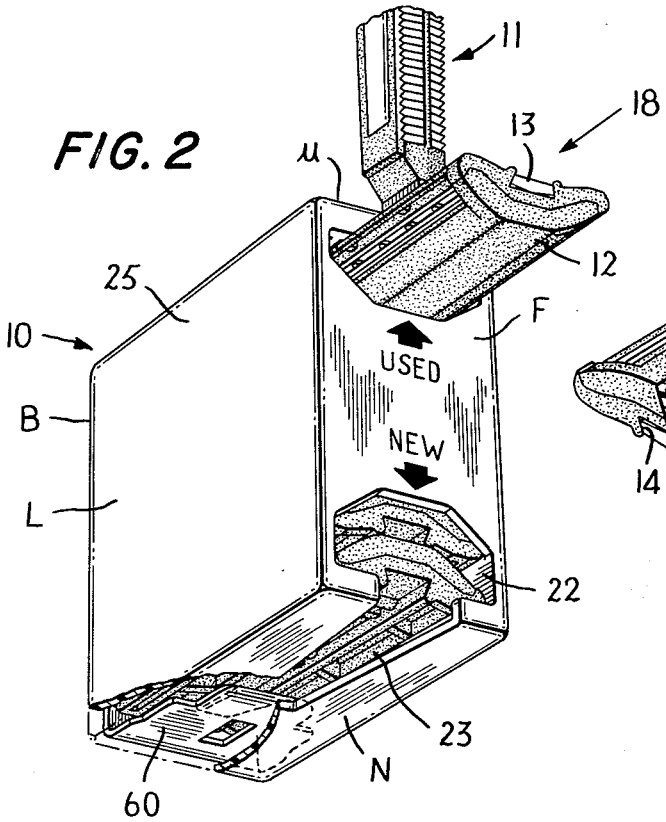
FIG. 2 is a view in perspective with a used blade being inserted into the magazine.
Figure 3:
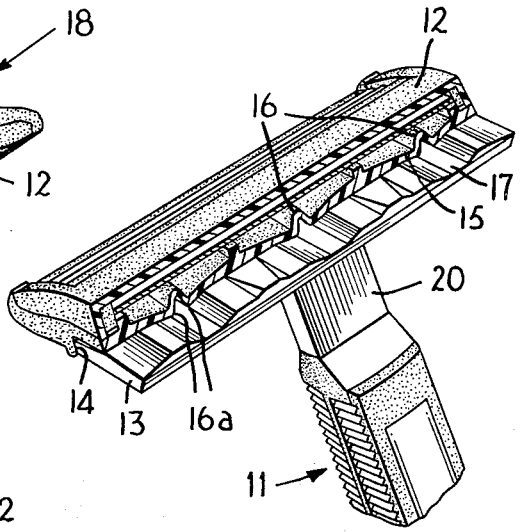
FIG. 3 is a view in perspective of the assembled razor with parts of the cartridge broken away to show the connection to the handle.

FIGS. 1 to 3 show the general features of a magazine 10 embodying the features of the invention and an associated razor 11 with a blade cartridge 12. The magazine 10 contains a stack of the cartridges 12 vertically arranged therein and the magazine and razor are compatibly shaped and designed to enable ready exchange of a used cartridge for a new cartridge. The particular cartridge shown is of the type disclosed in an application of the present inventor filed Dec. 11, 1972, Ser. No. 313,742, the cartridge having generally an oblong or rectangular shape and being of a generally double edge type employing two pairs of small blades with the blades at each edge arranged in superposed but spaced relation. The same application discloses the razor handle similar to that designated 11 herein compatible with the cartridge in which the handle has a head or key 13 arranged to have a slidable dovetail fit in the cartridge. As shown in general herein the dovetail slot 14 in the cartridge has positioned therein a flexible detent bar 15 having a plurality of pressure pads 16 adapted to engage releasably in notches 17 of the key 13 of the razor. As will be described more fully hereinafter to change cartridges the razor head is inserted through the front end wall of the magazine as indicated by the arrow 18 in FIG. 2 and in its continued advance through a first opening 19 the cartridge engages the rear wall of the magazine and is restrained therein, but the neck 20 with the key 13 of the razor handle may continue on through the neck 20 advancing through slot 21 leaving the used cartridge in the magazine housing. Then to pick up a new cartridge the razor head is inserted into a second opening 22 at the bottom of the front end wall the neck 20 being free to advance in the bottom slot 23 to approximately the mid position at the inner end 24 of the slot in which position the new cartridge occupies the position substantially as shown in FIG. 3 and upon the reverse outward movement of the handle the new cartridge remains with the handle by reason of the detent pressure pad 16 being engaged in the respective notches 17 of the key 13.

The present invention concerns the magazine and particularly the internal construction and functioning thereof and in that respect is a modification of the magazine disclosed and claimed in my previous U.S. Pat. application Ser. No. 334,746 filed Feb. 22, 1973.

FIGS. 4 to 7 show the magazine empty of any cartridges. It includes a main housing or casing 25 of preferably plastic material. Because of the necessity of orienting the various figures differently in the drawings for clarity of disclosure the six sides of the magazine will be individually identified in the figures by reference characters. Such characters are based on the position or orientation of FIG. 2. As there shown the top side is designated U in accordance with the fact used cartridges are inserted at that end, and the bottom side is designated N since new cartridges are withdrawn at that end. Consistently, the front and back end walls are designated F and B respectively and the right and left sides as R and L respectively. It should be understood that the reference characters selected are purely for convenience in connection with the drawings and in actual use the casing may be oriented differently such that for example the right side becomes left side, etc.

The housing 25 is open at the back or rear side B and has the slot 21 in the top end wall U and the shortened slot 23 in the bottom end wall N and the cartridge openings 19 and 22 in the front end wall F. Mounted within the casing 25 is a spring clip member 40 of elastic material such as sheet spring metal. The spring member is generally U-shaped in cross section with the legs arranged at a sharp right angle with respect to the connecting base portion 41. The base portion conforms in general shape to the rear opening of the casing and forms the back wall B of the magazine.

Up to this point in the detailed description the construction referred to is generally similar to that of said patent application Ser. No. 334,746. Features of the present modified magazine construction will now be described.

Figure 6:
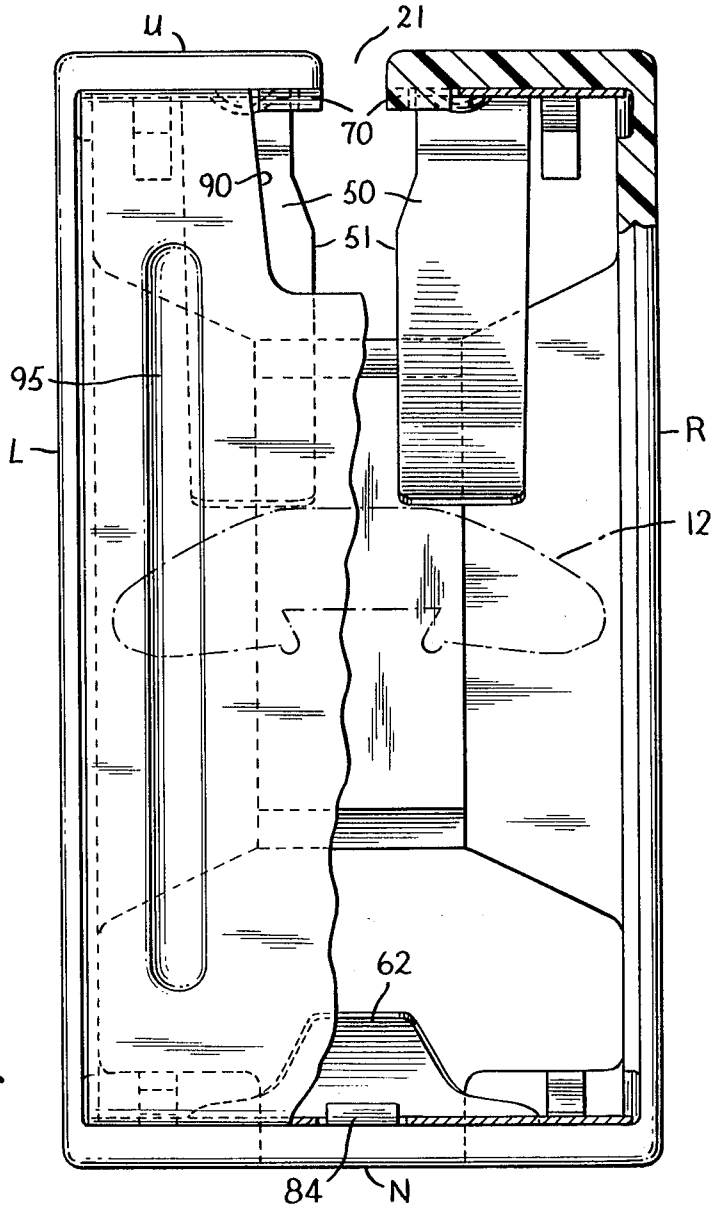
FIG. 6 is a vertical view looking from the rear with a portion of its back plate broken away.
Figure 7:
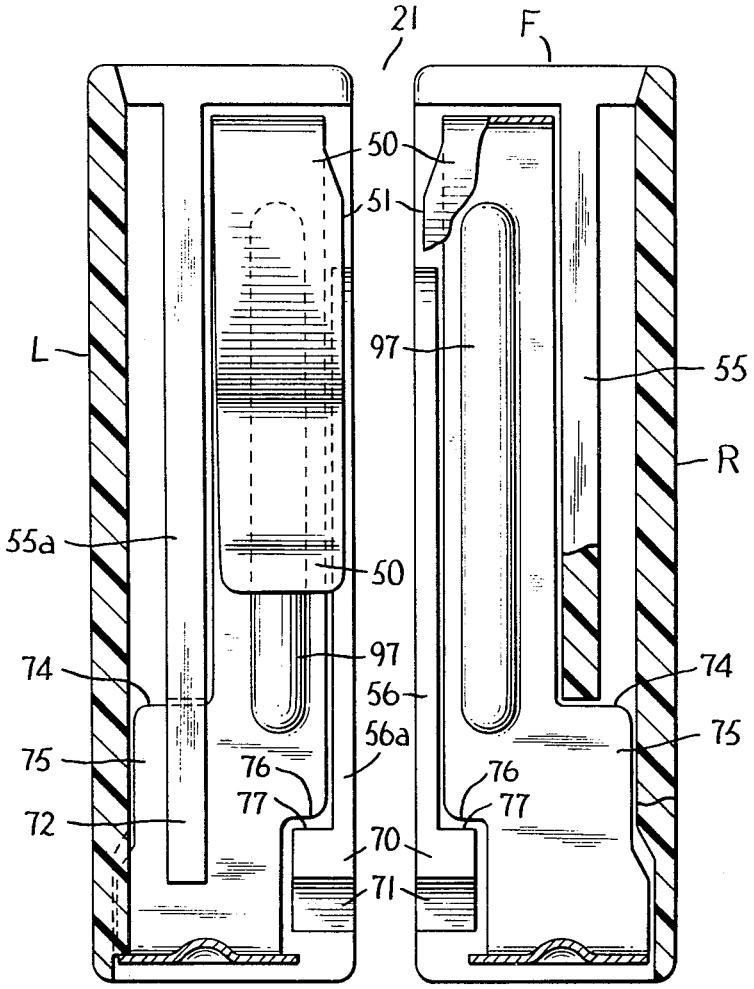
FIG. 7 is a horizontal cross sectional view taken on the plane VII—VII of FIG. 4.
Figure 9:
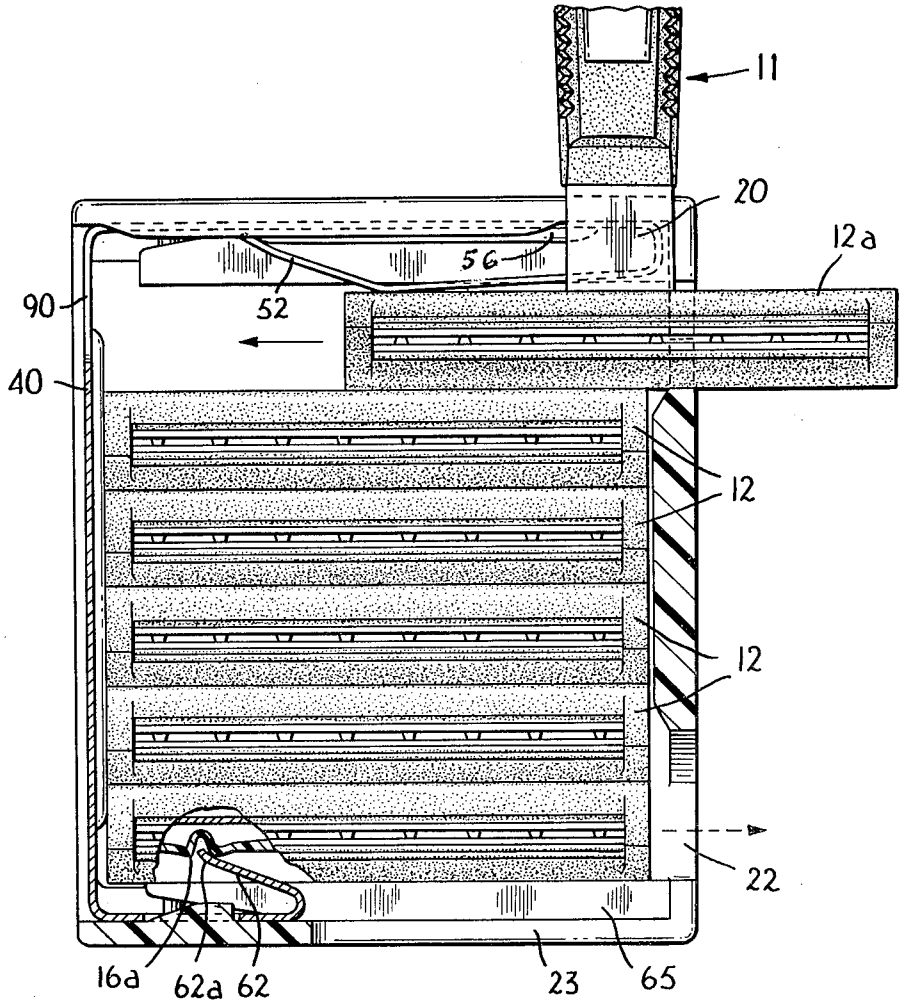
FIG. 9 is a view similar to FIG. 8 with a used cartridge partially inserted.
Figure 8:
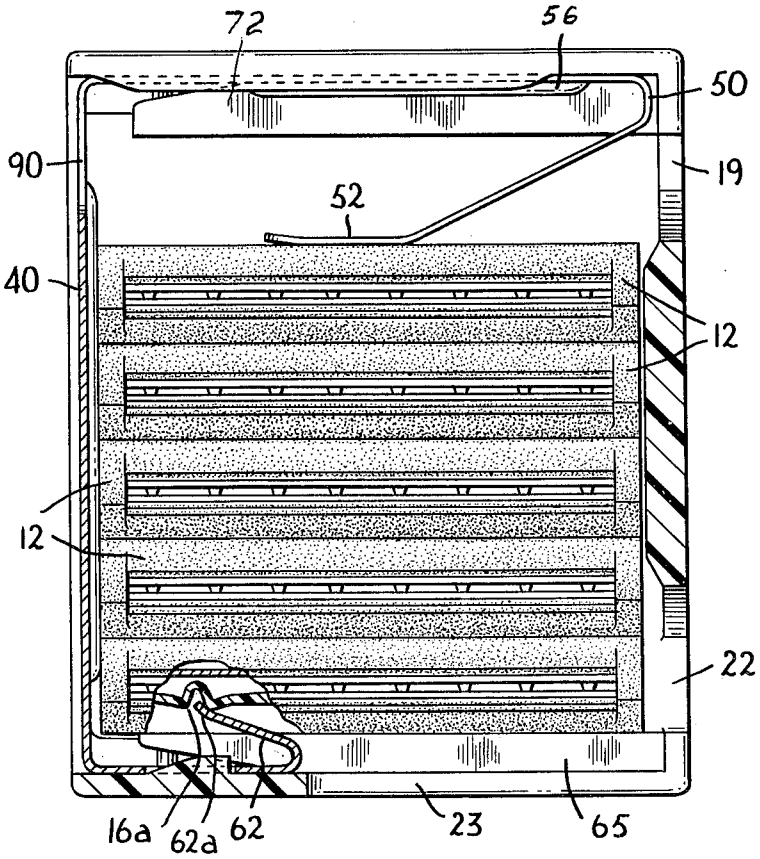
FIG. 8 is a vertical cross sectional view of a loaded magazine.

With the magazine oriented to the position shown in FIGS. 1 and 2 and also FIGS. 8 and 9, what is then the upper leg of the spring member 40 is bifurcated to form two laterally spaced leaf members or fingers 50 with an intervening slot 51 (FIGS. 6 and 7). Preferably the fingers 50 have their end portions 52 bent upwardly as will be noted hereinafter in connection with FIGS. 8 and 9. The fingers 50 are each positioned in a groove between a pair of ribs or rails, extending downwardly from the top wall parallel to the slot 21 comprising on the right side, as shown in FIG. 7, an outer rail 55 and an inner rail 56 which is smaller in height and thickness. Corresponding rails 55a and 56a are located on the opposite side of slot 21. Further features of the fingers 50 will be described shortly.

Figure 5:
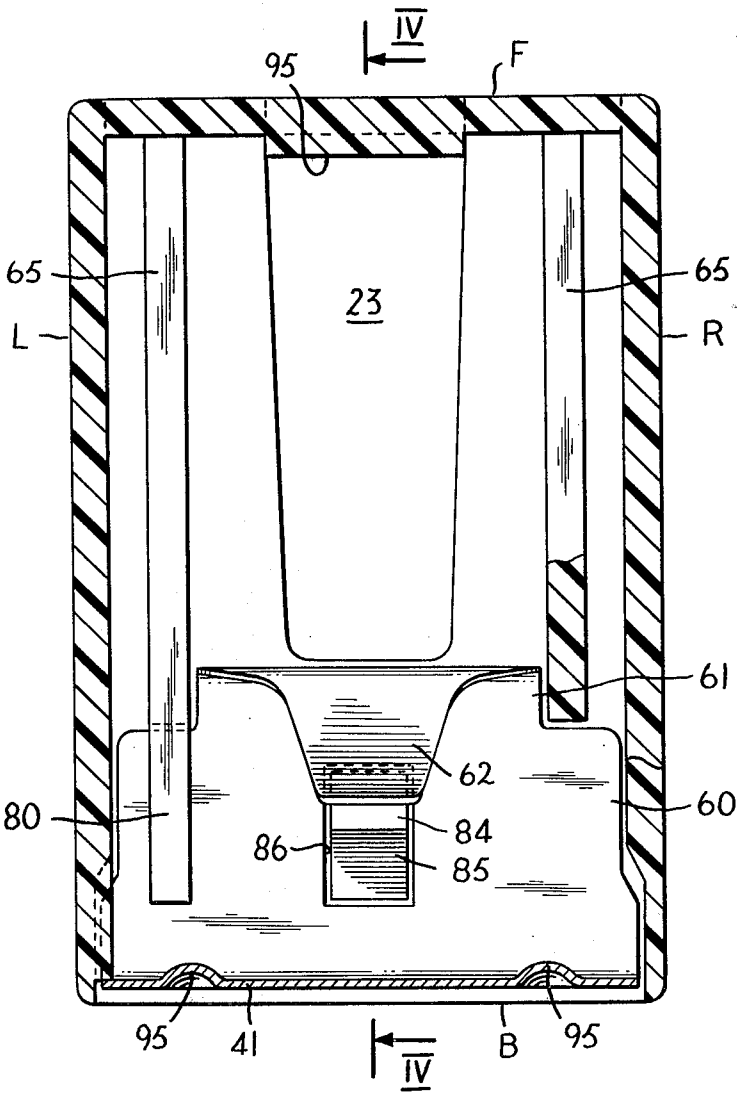
FIG. 5 is a horizontal cross sectional view taken on the plane V—V of FIG. 4.

The bottom leg of the spring clip member 40 is shaped differently. It includes a relatively wide portion 60 immediately adjacent the spring clip base or rear wall 41, a narrower portion 61 which is progressively reduced in width into a reverse bend tongue portion 62 (FIG. 5). The narrower portion 61 is seated between a pair of parallel ribs 65 extending upwardly from the bottom wall of the casing, the function of which will be described hereinafter.

In assembling the magazine the spring member will be preloaded with five cartridges in the present case arranged flatwise as between adjacent ones as indicated in FIG. 8 with the cartridge key slots 14 facing downwardly and the loaded member then slides forwardly into the casing through the back wall opening and is secured in position through interlocking elements to be described hereinafter. The back plate section 41 of the spring member forms the rear wall B of the assembled magazine.

As the loaded spring member is advanced into the magazine housing to the final position shown in FIG. 8, the upper fingers 50 ride up and over a pair of lugs 70 projecting downwardly from the top wall U, the lugs having rearwardly facing ramps 71 (FIG. 7). The fingers proceed down the channels between the pairs of rails 55, 56 and 55a, 56a respectively. The ribs 55, 55a at their rear ends have a downwardly projecting end prong 72 forming a wedge shaped notch 73 (FIGS. 4, 7) into which the forward edges 74 on the wide portions 75 of the fingers advance, until the rearward edges 76 of the fingers snap over the square inner shoulders 77 of the lugs 70 locking the upper half of the spring member in place.

Figure 4:
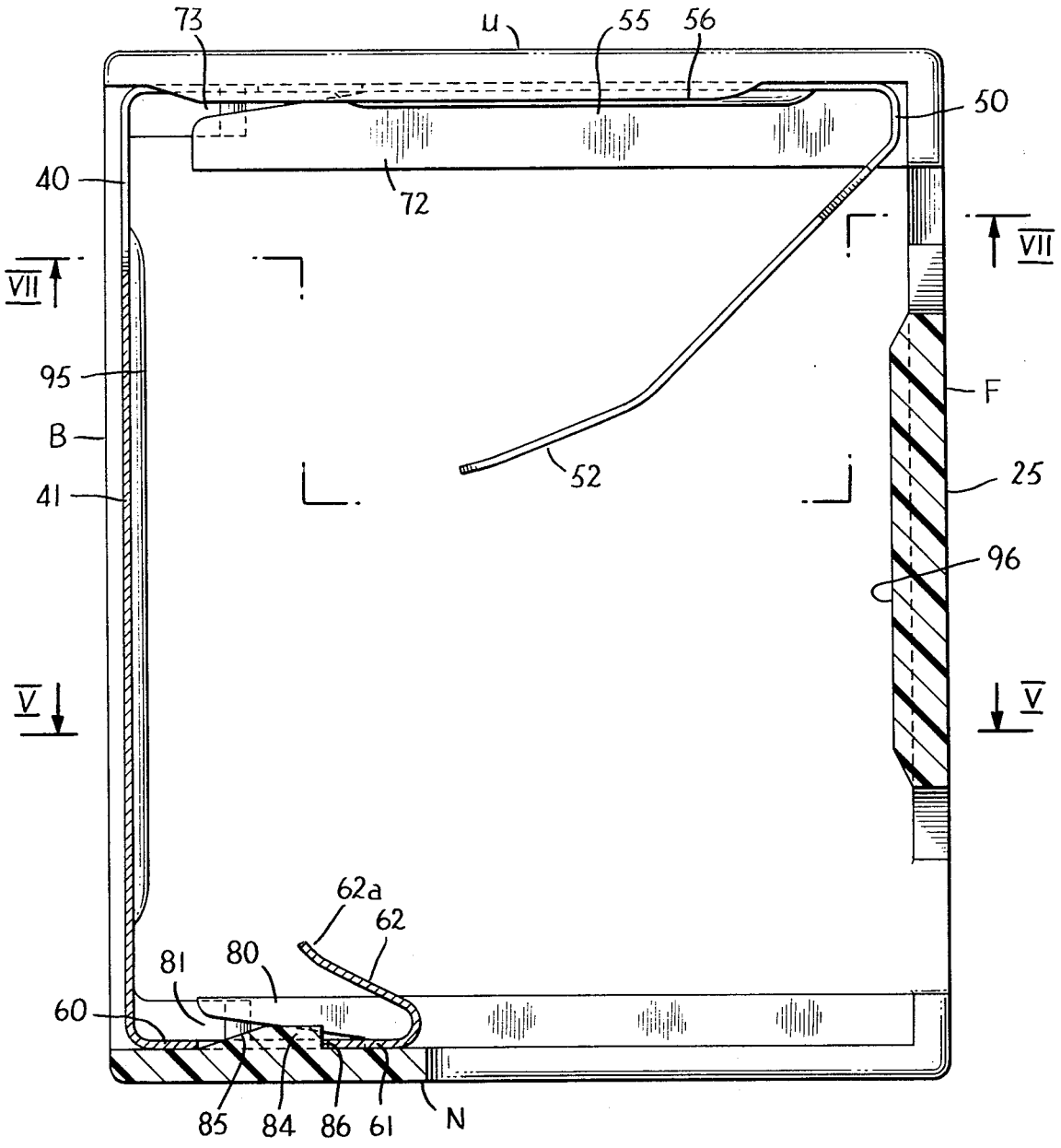
FIG. 4 is a vertical cross sectional view of an empty magazine taken on the plane IV—IV of FIG. 5.

Concurrently with the above functioning, the bottom leg of the spring member comprising the finger element 60, 61 and 62 progresses into the housing, the narrower part 61 advancing between the rails or ribs 65 (FIG. 5). The rails each have a wedge shaped end prong 80 extending toward the rear forming a wedge shaped notch 81 into which the wider portion 60 advances (FIGS. 4, 5). Midway between the sides of the housing the bottom wall has an upstanding lug 84 with a rearwardly facing ramp 85. The part 60 has a complemental rectangular opening 86 and the advance continues up the ramp until the opening snaps over the lug 84 and the parts are locked together by the engagement of the finger over the forward square shoulder 86 of lug 84.

The final assembly is shown in cross section in FIG. 8 the stack of cartridges resting on the side rails 65 under the moderate pressure of upper spring fingers 50, 52, the rails 65 serving as rigid stops and support means, the lower spring tongue 62 being engaged in the key slot 14. The cartridges 12 are symmetrically shaped in transverse section and the spring fingers 50 at the top and the rails 65 at the bottom are spaced apart in a symmetrical arrangement resulting in a four point balanced support of the cartridge stack.

The tongue 62 functions to releasably restrain the bottom cartridge from inadvertently escaping out the opening 22 under conditions of a sudden jar and particularly when the magazine unit is oriented with the front wall F facing downwardly. The restraining means may be effected in various ways such as by spring tongue having sufficient pressure to frictionally restrain the cartridge. In the case of the present type of cartridges a particularly effective and dependable restraining means is provided resulting from the nature of the cartridge construction which includes a central flexible detent bar 15 having pressure pads 16 as previously described. It may be noted that each pressure pad 16 is generally of an inverted U-shape with a transverse slot between opposed shoulders 16a (FIGS. 3, 8 and 9). As indicated in FIGS. 8 and 9 the extreme end **62*a* of the tongue 62 is shaped and arranged normally to engage against the left shoulder 16*a* of the innermost pressure pad 16 to lock the cartridge against outward movement. When, however, the key 13 of the razor head is inserted it engages and depresses the tongue 62** releasing the lock.

To change a cartridge the razor is applied in inverted position and the cartridge **12*a* advanced in contact with the top cartridge 12 as indicated in FIG. 9 compressing the spring fingers 50 the razor stem 20 moving along the slot 21. The upper rails 72 ensure that the inserted cartridge 12a is maintained parallel to the top cartridge in the stack, and the stack remains stationary by reason of resting on the bottom rails 65. The rails or ribs 56, 56*a* ensure that the spring fingers are maintained in their respective channels and do not interfere with the advance of the razor key 13. The opening 19 in the front wall is shaped to admit freely the used cartridge but the back wall 41 formed by the spring member has an opening 90 suitably shaped to permit the razor head key 13 to continue on through but restrain the used cartridge 12a** which remains on the top of the stack inverted with respect to the new cartridges below.

To pick up a new cartridge the razor head is now advanced through the opening 22 with the stem 20 moving in slot 23 which is of a length to permit the detent means 16, 17 (FIG. 3) to snap into engagement and the assembled new cartridge is withdrawn as indicated in FIG. 1. This is readily effected since the outer end of the bottom cartridge 12 is fully exposed in the opening 22 and the cartridge is maintained in parallelism with the next upper cartridge by riding on the spaced rails 65. The razor head key 13 readily depresses the spring tongue 62 permitting the key to advance into its fully seated home position. Upon withdrawal of the cartridge the stack reassumes the position shown in FIG. 8.

Among other features it may be noted that the rear wall 41 of the spring member has two spaced trough-like depressions 95 forming guide ribs of reduced friction for the blade stack in its downward movement, and the forward wall of the magazine has interiorly a low friction pressure pad area 96 against which the forward ends of the cartridges ride. The ribs 95 also perform the additional function of strengthening and stiffening the back portion 41 of the spring member. The fingers 50 of the upper leg of the spring member have similar trough depressions forming ribs 97 in the portions located in the channels 51 to add rigidity.

Since various changes may be made in the structural details and relations of the parts shown and described herein and accordingly different embodiments of the invention be made within the principles thereof, it is intended that all matter contained herein shall be interpreted as illustrative and not in a limiting sense.

What is claimed is:

1. A magazine combination for razor blade cartridges of a generally oblong shape comprising a housing, a stack of cartridges arranged flatwise each against an adjacent one therein, said housing having a front end wall with a first opening at one end of the wall thereof for the endwise insertion of a used cartridge, and a second opening at the other end of the wall for endwise extraction of a new cartridge, and elastic means arranged to urge the stack toward said second opening, a rigid stop means against which the stack and the end new cartridge are normally maintained by said elastic means, the end cartridge being fully exposed at said second opening for endwise extraction, said elastic means comprising a pair of laterally spaced spring fingers with a slot between to receive a razor handle part slidable therein, and said housing having a back end wall with an exit opening opposite said first opening in the front wall shaped to permit the free exit of the handle part but restrain the inserted used cartridge.

2. A magazine in accordance with claim 1 in which said stop means comprise laterally spaced guide rails extending inwardly from said second opening.

3. A magazine in accordance with claim 2 in which said end cartridge has a slot located between said guide rails and the adjacent wall of the housing has a slot registering with the cartridge to enable a razor handle to move into engagement with the cartridge slot for the endwise extraction of said end cartridge.

4. A magazine in accordance with claim 1 in which said first opening is of a shape and positioned to enable the endwise insertion of a used cartridge by endwise advance parallel to the adjacent cartridge of the stack.

5. A magazine in accordance with claim 4 in which said elastic means comprises a pair of laterally spaced spring fingers with a slot between to receive a razor handle part, and said housing has a pair of spaced rails extending inwardly from said first opening between which the spring fingers are located.

6. A magazine in accordance with claim 1 in which a spring element is mounted within the housing arranged to engage the inner end of said end cartridge to restrain it from accidental release.

7. A magazine in accordance with claim 1 in which said end cartridge has a middle slot facing away from said elastic means for engagement by a razor head, and a spring element is mounted within the housing with a tongue portion engaged in said slot at the inner end of said end cartridge and arranged in relation to said slot to restrain the cartridge from accidental release.

8. A magazine in accordance with claim 7 in which the cartridge slot has a shoulder therein and the tongue has an end normally engaged against the shoulder to restrain the cartridge against release, said tongue being depressible by insertion of the razor head to release the tongue from engagement against the shoulder.

9. A magazine combination for razor blade cartridges of a generally oblong shape comprising a housing, a stack of cartridges arranged flatwise each against an adjacent one therein, said housing have an end wall with an opening for endwise extraction of a cartridge at the end of the stack at said opening, elastic means arranged to urge the stack toward said opening, said cartridges each having a middle longitudinal slot with an open side facing away from said elastic means adapted to slidably receive therein a razor handle head, and said housing having an elastic tongue element engageable in said slot in the cartridge at said opening to releasably restrain the cartridge from extraction.

10. A magazine combination for razor blade cartridges comprising a housing having an end wall with an opening for the endwise extraction of a cartridge, a cartridge in said housing having an end exposed at said opening, said cartridge having a longitudinal slot at its bottom face with a shoulder part therein, and a spring element in said housing with a tongue portion engaged against said shoulder part to restrain the cartridge from accidental release.

11. A magazine combination in accordance with claim 10, said tongue portion being depressible by insertion of a razor head to release the cartridge for extraction with the razor head.

* * * * *